US012465829B2

(12) United States Patent
Hageman et al.

(10) Patent No.: US 12,465,829 B2
(45) Date of Patent: Nov. 11, 2025

(54) PORTABLE BALL GAME SYSTEM AND METHOD OF USE

(71) Applicant: Well Played, LLC, Madison, WI (US)

(72) Inventors: Nicole M. Hageman, Madison, WI (US); Zach E. Huber, Sun Prairie, WI (US); Claude P. Drehfal, Madison, WI (US); Ben J. Fisher, Madison, WI (US)

(73) Assignee: Well Played, LLC, Madison, WI (US)

( * ) Notice: Subject to any disclaimer, the term of this patent is extended or adjusted under 35 U.S.C. 154(b) by 543 days.

(21) Appl. No.: 18/097,378

(22) Filed: Jan. 16, 2023

(65) Prior Publication Data

US 2023/0226422 A1 Jul. 20, 2023

Related U.S. Application Data

(60) Provisional application No. 63/299,779, filed on Jan. 14, 2022.

(51) Int. Cl.

| | |
|---|---|
| ***A63B 67/06*** | (2006.01) |
| ***A63B 47/00*** | (2006.01) |
| ***A63B 71/00*** | (2006.01) |

(52) U.S. Cl.

CPC ..... *A63B 67/066* (2013.01); *A63B 47/00* (2013.01); *A63B 71/0036* (2013.01); *A63B 2209/08* (2013.01); *A63B 2210/50* (2013.01); *A63B 2225/74* (2020.08); *A63B 2243/0062* (2013.01)

(58) Field of Classification Search

CPC ... A63B 67/066; A63B 47/00; A63B 71/0036; A63B 2209/08; A63B 2210/50; A63B 2225/74; A63B 2243/0062; A63B 67/02; A63B 69/3676

See application file for complete search history.

(56) References Cited

U.S. PATENT DOCUMENTS

| | | | | |
|---|---|---|---|---|
| 5,031,919 | A * | 7/1991 | Dixon | A63F 7/0005 273/352 |
| 5,104,130 | A | 4/1992 | Francin | |
| 8,851,474 | B2 | 10/2014 | Shirvinsky, Sr. | |
| 9,174,112 | B1 | 11/2015 | Park | |
| 9,539,490 | B2 | 1/2017 | Park | |
| 10,406,416 | B2 * | 9/2019 | Cohen | A63B 67/02 |
| 11,065,519 | B1 * | 7/2021 | Bahash | A63B 57/40 |
| 11,400,354 | B2 * | 8/2022 | Allen | A63B 67/066 |
| 2006/0040761 | A1 * | 2/2006 | Shin | A63B 67/02 473/278 |
| 2007/0262518 | A1 | 11/2007 | Lapinski et al. | |

(Continued)

FOREIGN PATENT DOCUMENTS

DE 9411350 12/1994

*Primary Examiner* — Michael D Dennis
(74) *Attorney, Agent, or Firm* — AVEK IP, LLC

(57) ABSTRACT

A portable game where balls are rolled over a ramp at targets. The game incorporates aspects of bocce ball with the additional challenge of a ramp and different types of targets. The game can roll up into an easily transportable package with all game pieces stored inside the roll. The roll can then be deployed to act as a portion of the game's playing surface in any suitable location. The game consists of balls, a runner, a ramp, and different forms of targets. The runner could be made of slats, fabric, or other materials that are flexible and can be rolled. The balls are similar to bocce balls but could be lighter or smaller for easy transport.

14 Claims, 9 Drawing Sheets

(56) References Cited

U.S. PATENT DOCUMENTS

| | | | | |
|---|---|---|---|---|
| 2016/0008692 | A1* | 1/2016 | Townsend | A63B 71/0036 206/315.1 |
| 2023/0226425 | A1* | 7/2023 | Taylor | A63B 69/3676 473/278 |

* cited by examiner

PORTABLE BALL GAME SYSTEM AND METHOD OF USE

CROSS-REFERENCE TO RELATED APPLICATION

This application claims priority in U.S. Provisional Patent Application No. 63/299,779 Filed Jan. 14, 2022, which is incorporated herein by reference.

BACKGROUND OF THE INVENTION

1. Field of the Invention

The present invention relates generally to a portable ball game system and method for use thereof, and more specifically to a portable ball game system with transformable container for creating playing surface and containing game elements therein.

2. Description of the Related Art

Yard games are widespread and entertaining for persons of all ages. It is typically desirable for yard games to be self-contained, easily portable, and immediately engageable by persons of all ages, while also containing high level skill caps for those seeking a challenge. Yard games commonly employ balls or other tossed or rolled objects for scoring and engaging with the game system(s).

Heretofore there has not been available a system or method for a portable ball game system with the advantages and features of the present invention.

BRIEF SUMMARY OF THE INVENTION

The present invention generally provides a 1-4 player game where balls are rolled over a ramp at targets, though more players could be supported in certain embodiments. The game incorporates aspects of bocce ball with the additional challenge of a ramp and different types of targets. The game can roll up into an easily transportable package with all game pieces stored inside the roll. The roll can then be deployed to act as a portion of the game's playing surface in any suitable location.

A preferred embodiment provides a game system which can be used in a yard, while tailgating, outdoors (e.g. at a restaurant or event), or even indoors. The game consists of balls, a runner, a ramp, and different forms of targets. The runner could be made of slats, fabric, or other materials that are flexible and can be rolled. The balls are similar to bocce balls but could be lighter or smaller for easy transport. This embodiment of the game system can be played with 1 to 4 players.

Balls are rolled over the ramp during gameplay. During a one-person game the player aims for the highest number of points shooting at the targets with all the balls except the small target ball (pallino). Points are tallied and the player tries to get a record score with all of the balls included.

During a two-player game, one player throws the smaller pallino target ball. Players get points by hitting the targets or by being closest to the pallino. Players get the number of points marked on each target for every ball that goes in a target. Similar to Bocce, the player that is closest to the pallino gets the number of points equal to how many of their Bocce are closer to the pallino than the other team's nearest Bocce. If the player's Bocce touches the pallino, it is called a Baci and the team earns 2 points for that ball. Players continue through rounds until a player hits 21. First to 21 wins.

A variation removes the pallino target. In this version, players roll the game balls up the ramp, and score points for landing in the targets, and the ball landing closest to the target, but not in, scores an additional point.

For a 4-player game, players team up, two players for each color, and take turns. Scoring is the same as the two-player game.

The runner can roll up around or into the ramp portion of the game with all game pieces stored inside. The game can be carried with a strap or handle and is easily transportable in a convenient package. The targets can stack inside of each other, with the game balls fitting inside them.

There are great possibilities for add-ons including lights for a night version or custom designs and graphics for a themed game set. A night version could include light up LED discs that are placed inside the targets to illuminate them, along with LED strips that could be placed along the ramp.

To set up for outdoor play in grass, the game can be staked down to keep the runner/slats taught as well as the targets in order to be held in place. For general play (whether indoor or outdoor; multi-terrain), the game can be supported using a framework to strengthen the rolled up game. The framework would support the proper ramp shape. The targets can be weighed down to keep them in place during play.

BRIEF DESCRIPTION OF THE DRAWINGS

The drawings constitute a part of this specification and include exemplary embodiments of the present invention illustrating various objects and features thereof.

DETAILED DESCRIPTION OF THE PREFERRED EMBODIMENTS

I. Introduction and Environment

As required, detailed aspects of the present invention are disclosed herein, however, it is to be understood that the disclosed aspects are merely exemplary of the invention, which may be embodied in various forms. Therefore, specific structural and functional details disclosed herein are not to be interpreted as limiting, but merely as a basis for the claims and as a representative basis for teaching one skilled in the art how to variously employ the present invention in virtually any appropriately detailed structure.

Certain terminology will be used in the following description for convenience in reference only and will not be limiting. For example, up, down, front, back, right and left refer to the invention as orientated in the view being referred to. The words, "inwardly" and "outwardly" refer to directions toward and away from, respectively, the geometric center of the aspect being described and designated parts thereof. Forwardly and rearwardly are generally in reference to the direction of travel, if appropriate. Said terminology will include the words specifically mentioned, derivatives thereof and words of similar meaning.

II. Preferred Embodiment Game System 2

Figure 1:
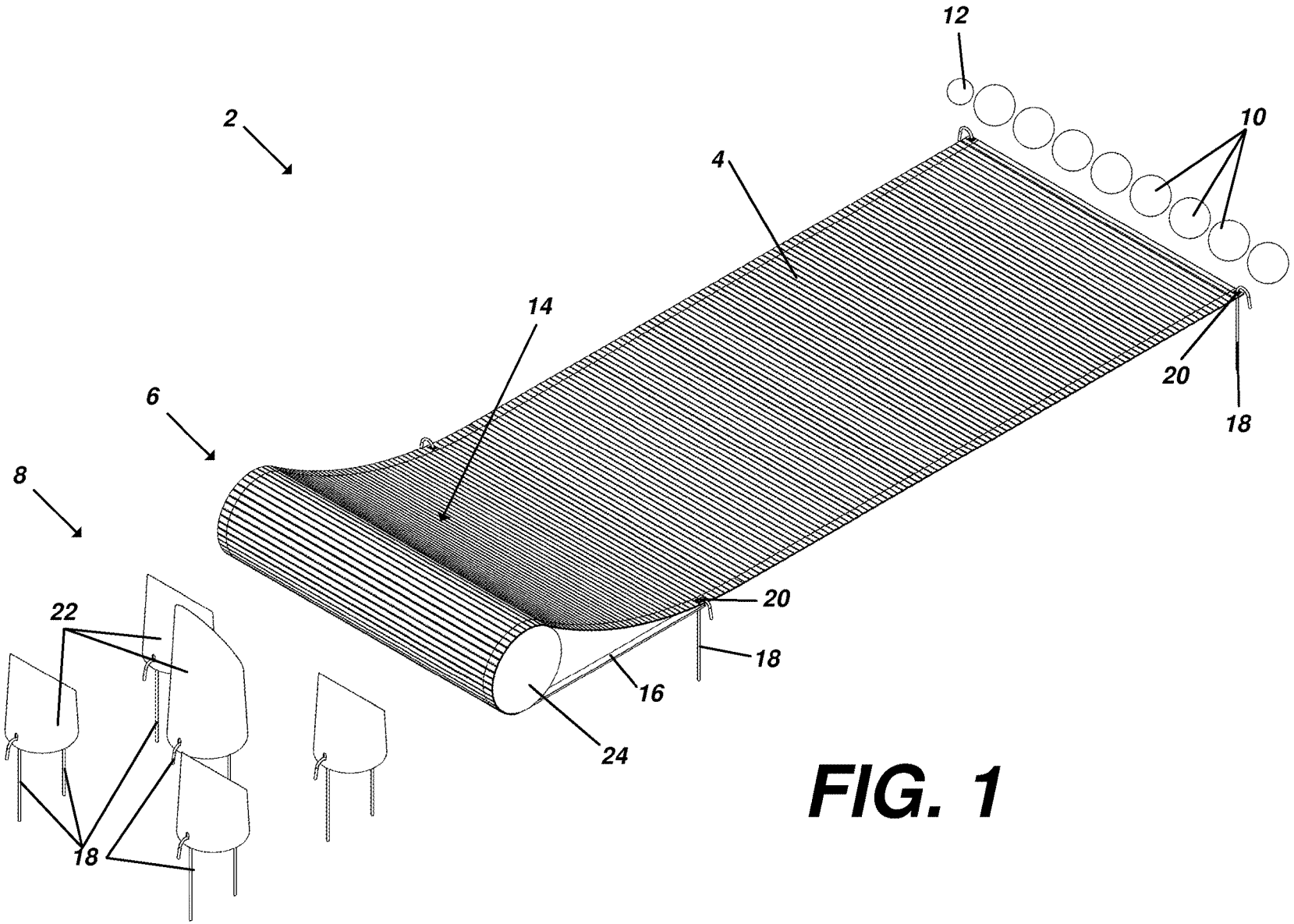
FIG. 1 is a three-dimensional isometric view of a preferred embodiment of the present invention shown in a deployed, in-use orientation.
Figure 2:
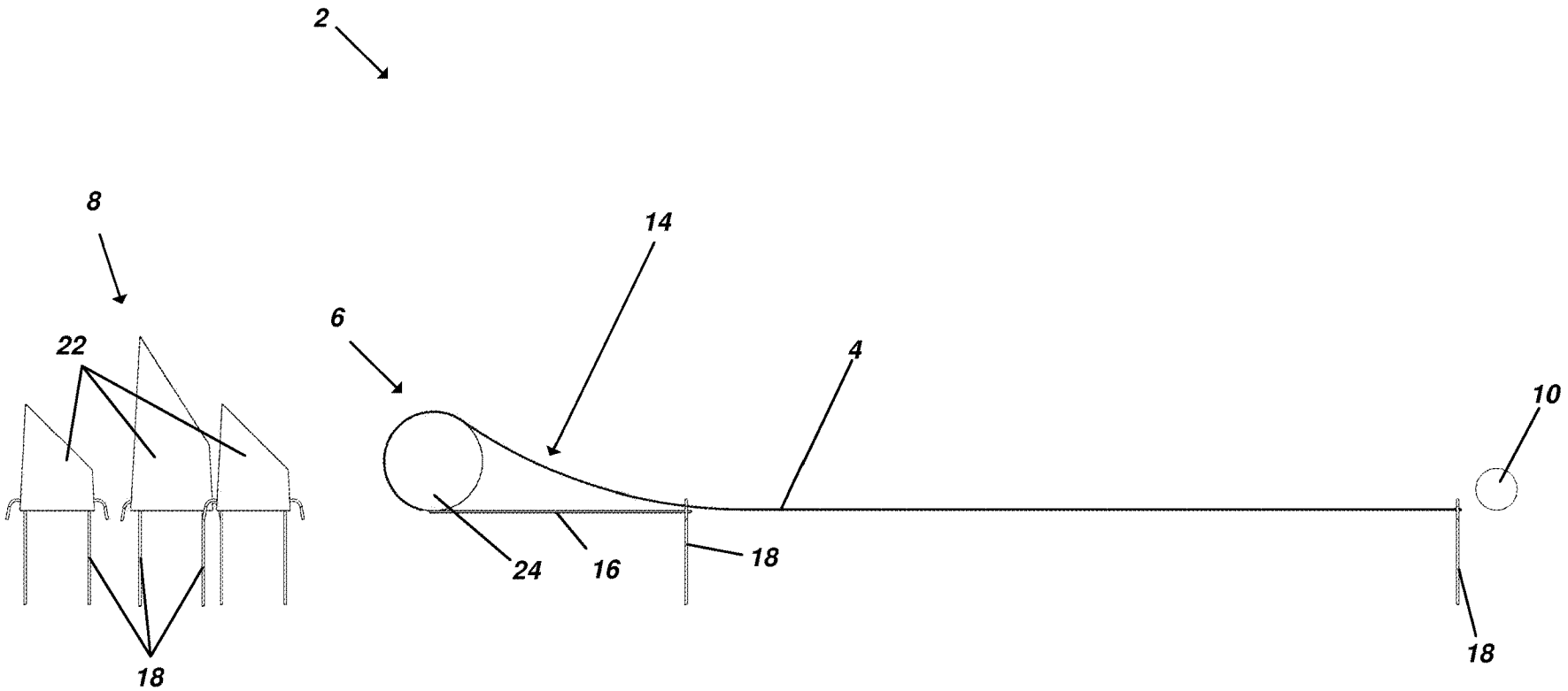
FIG. 2 is a side elevational view thereof.
Figure 3:
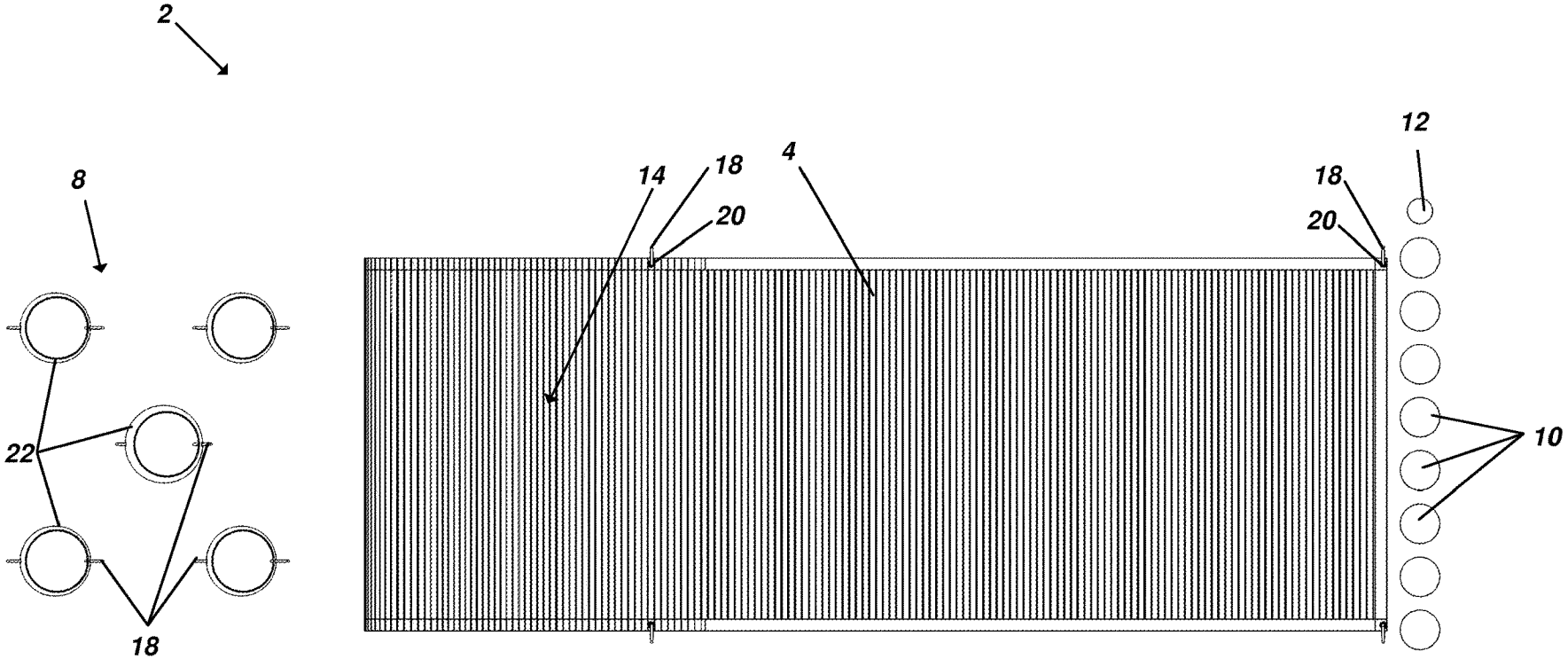
FIG. 3 is a top plan view thereof.
Figure 4:
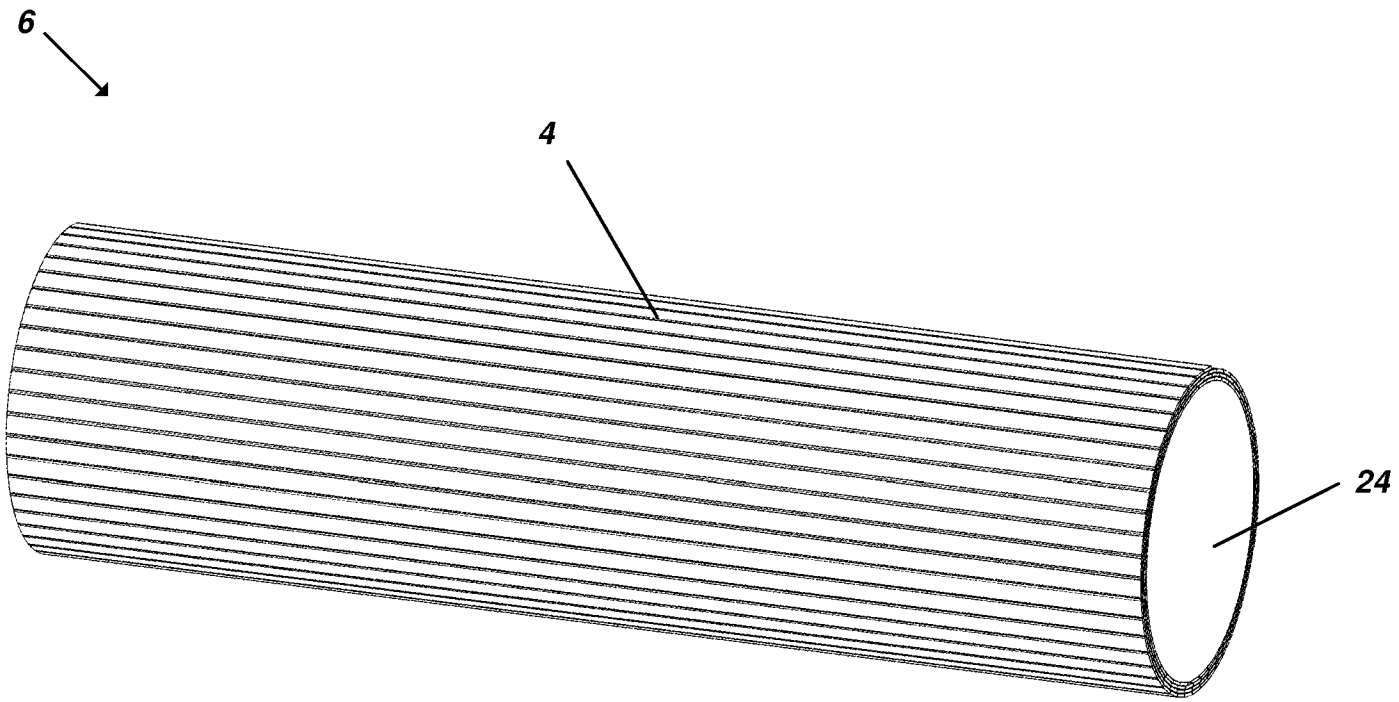
FIG. 4 is a three-dimensional isometric view shown in a stored orientation.
Figure 5:
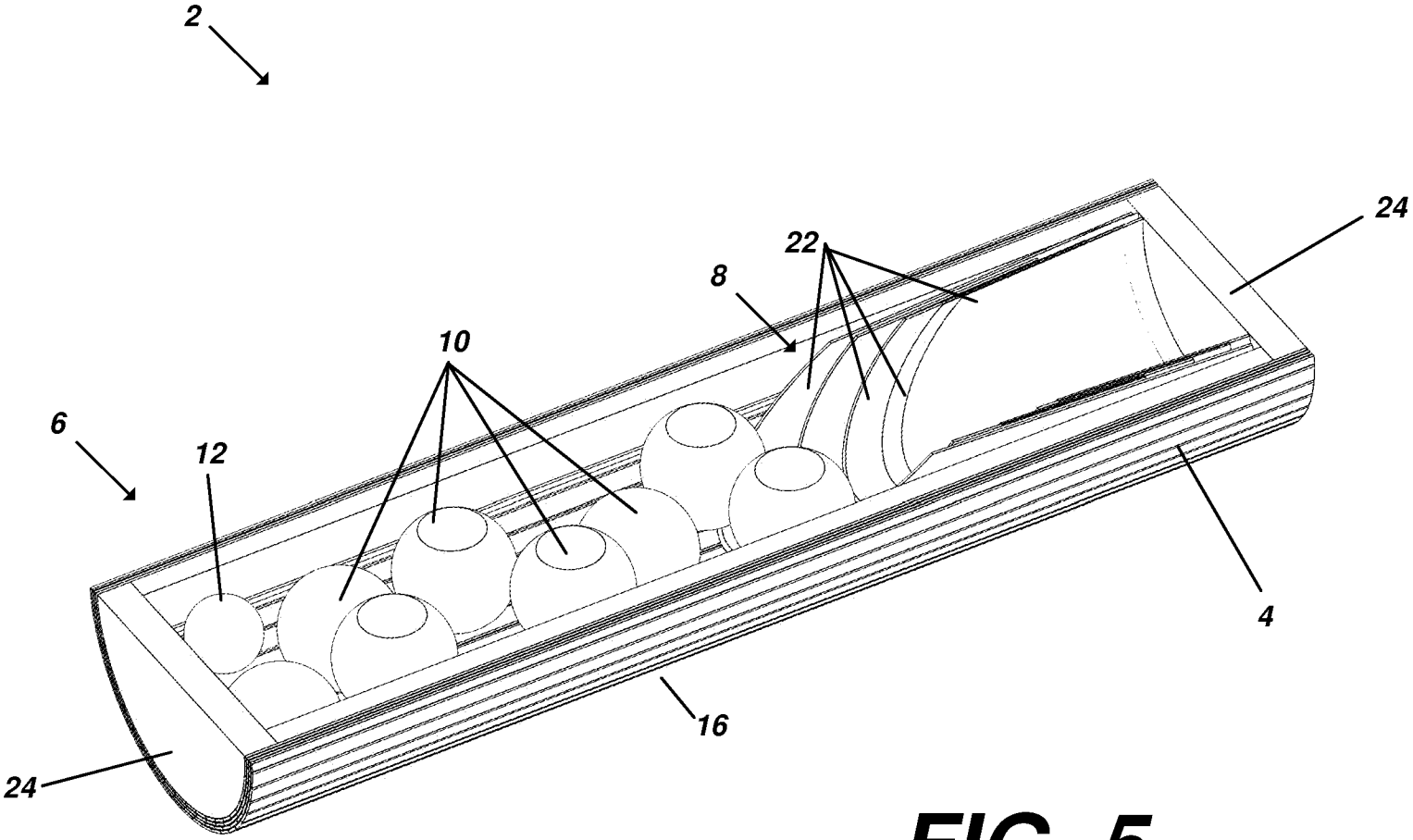
FIG. 5 is a sectional view thereof showing stored elements of the invention
Figure 6:
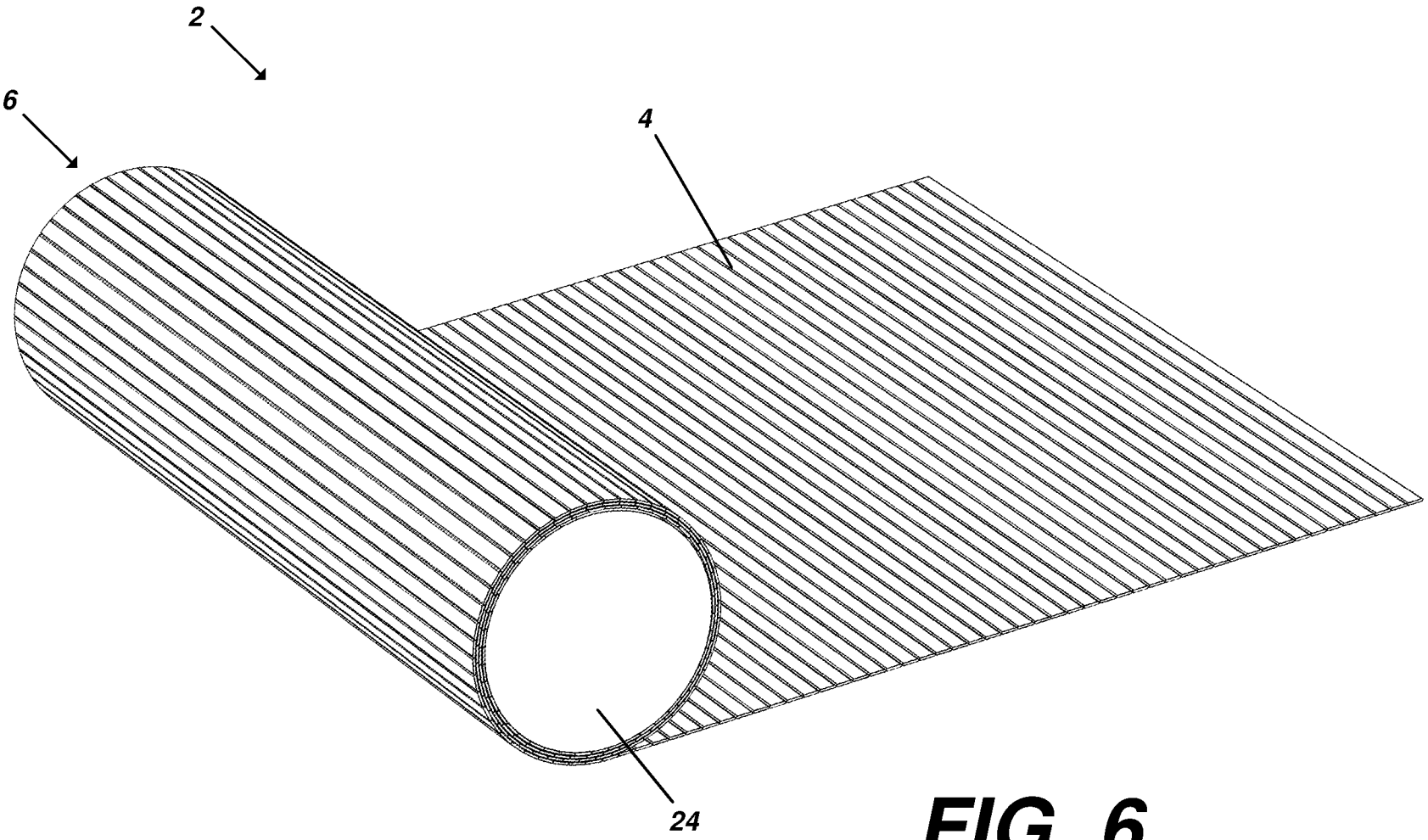
FIG. 6 is a three-dimensional isometric view from below showing the invention in a partially-deployed orientation.
Figure 7:
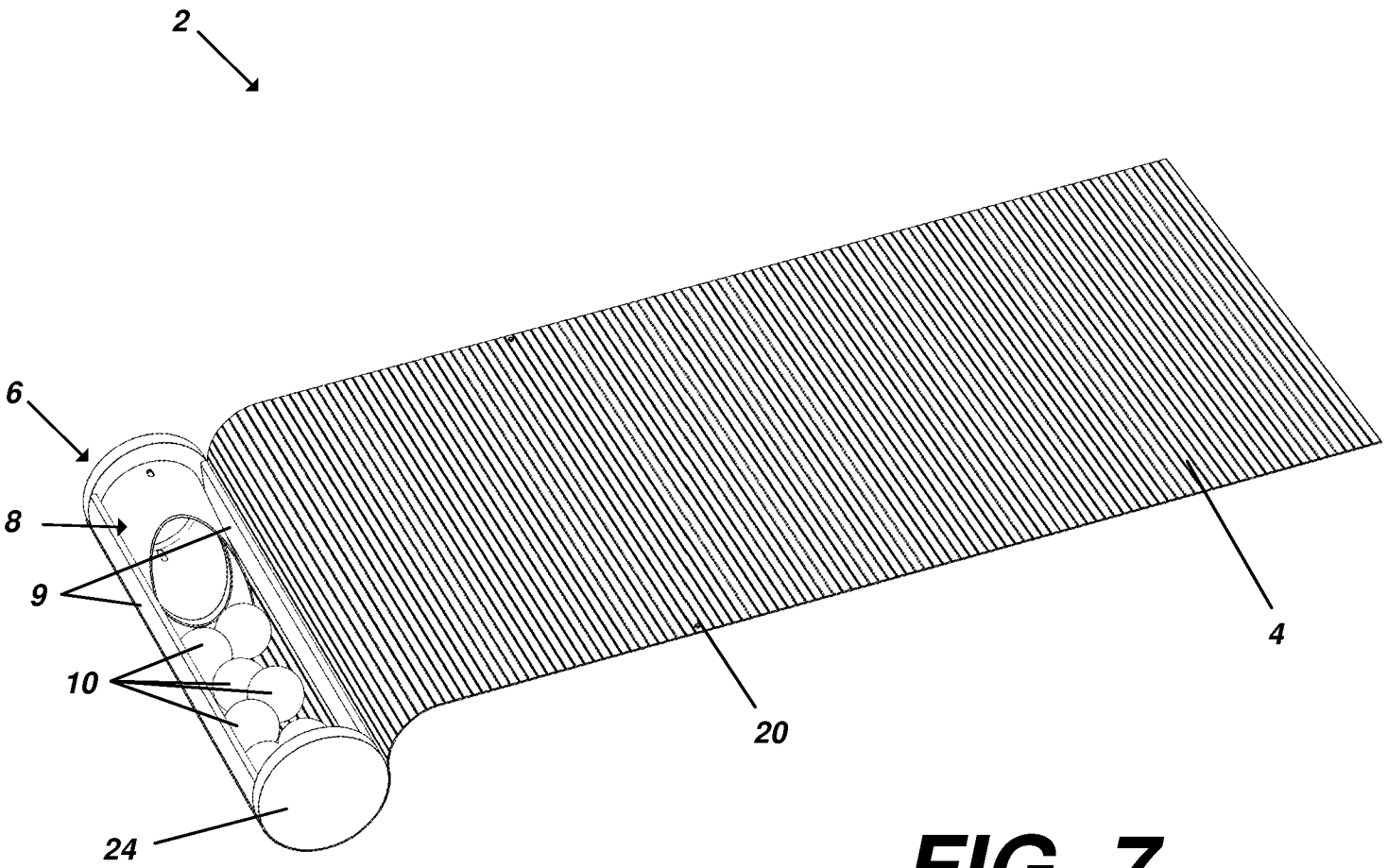
FIG. 7 is a three-dimensional isometric view thereof shown from below in a further deployed orientation with a sectional view of the storage cylinder element thereof.
Figure 8:
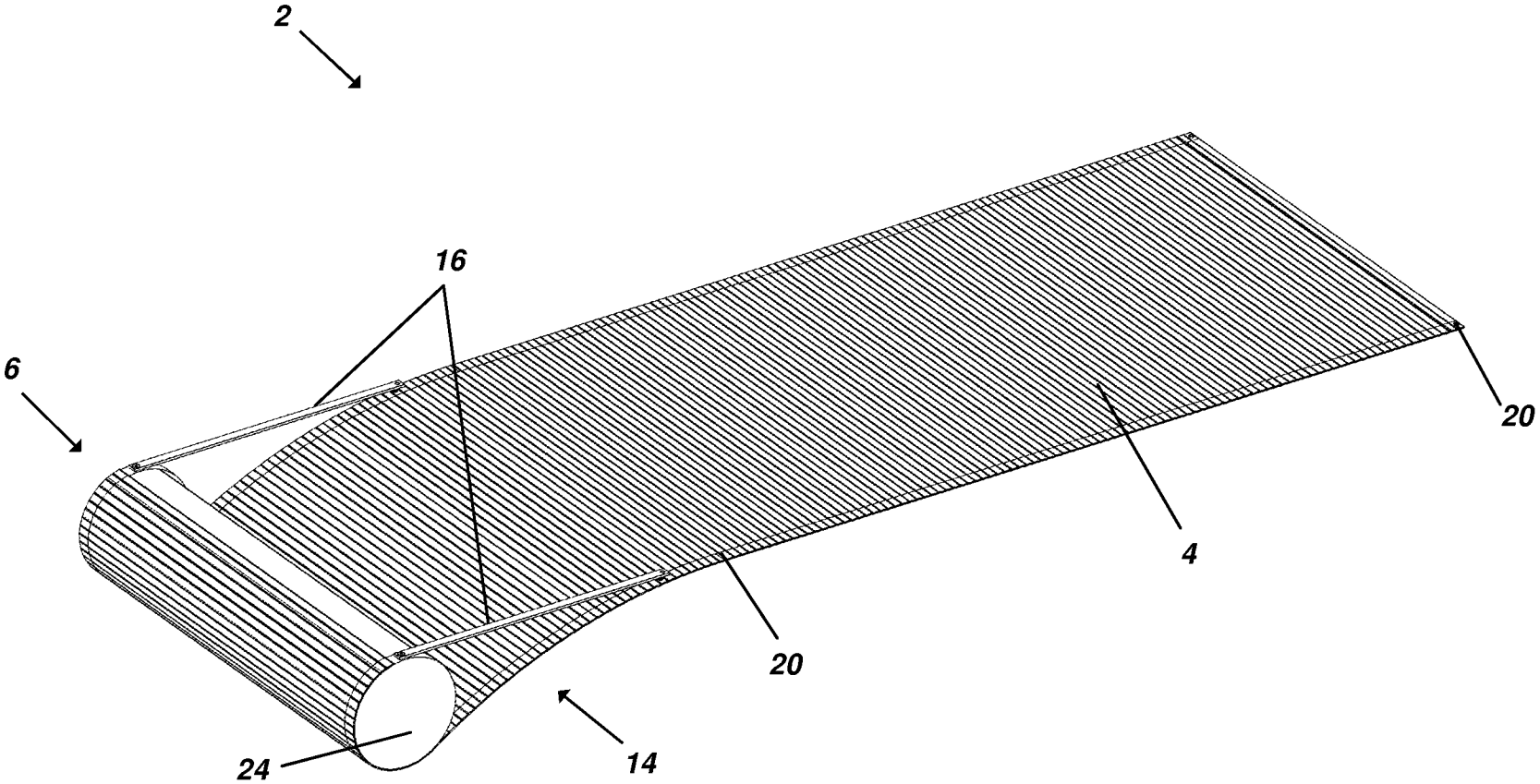
FIG. 8 is a three-dimensional isometric view thereof shown from below in a fully deployed orientation.

As shown in the figures, the present invention provides a portable game system 2 which can be converted from a first, deployed, and in-use orientation shown in FIGS. 1-3, and a second, stored, and portable orientation shown in FIGS. 4-5. FIGS. 6-8 show a partially deployed orientation. When in the stored, portable orientation, all of the balls 10, goals 8, pallino 12 (target ball), and any other necessary components to the game system 2 are stored within the cylindrical roll 6 shown in FIGS. 4-5. The balls 10 may be of differing colors to denote opposing teams. The balls 10 may be of different materials depending on playing surface (e.g. grass vs. concrete vs. wood flooring). When deployed, the roll 6 can unfurl into a ramp with a runner forming a playing field 4 affixed to one end of the ramp. When unfurled, this allows access to the interior of the roll where the balls, goals, and other elements would be stored as shown in FIG. 7

The cylindrical ends 24 of the roll help to form the ramp 14 which is part of the playing field runner 4 upon which the game system is played. When opened and unfurled into the deployed, in-use orientation, the runner 4 can be extended out towards where the users stand or sit to play the game. The ramp 14, formed from a portion of the runner 4 as shown in the figures, wraps partially around the cylindrical ends 24 of the roll 6, forming a gentle sloping ramp for the balls 10 to roll up and off of into the awaiting goals 8. Structural elements 9 within the roll 6 connect the two cylindrical ends 24 to provide structure and shape to the roll. These could be connecting rods, a rigid wall, or any other suitable structural elements to secure the cylindrical ends together.

The goals 8 can be set up as desired by the users behind the ramp. They can be spaced or moved to increase or decrease difficulty and depending on the rules on the particular game mode being played. Scoring can depend upon several factors, such as the use of a pallino 12 as a target ball, a ball's final resting orientation relating to the goals, and on other criteria. Systems for tracking scores can be included within the game and stored within the roll when not in use.

The goals 8 are formed from receiver cups 22 and may include ground stakes 18 for securing the receiver cups 22 to the ground. Similar ground stakes 18 are also used to secure the runner 4 to the ground via several receivers 20. A pair of support rods 16 can also be used to maintain the ramp's 14 slope by holding the runner 4 a distance away from the roll 6.

The entire assembly can be stored in any suitable storage medium for transportation, such as a canvas bag. Additional bags can be placed within the roll 6 when in the stored orientation to store various elements of the invention. Other items, such as a measuring stick, scoring table, and set of rules may be contained within either the bag or the roll.

The runner 4 could be made of any suitably flexible material. A simple bamboo mat, for example, could be used as could a cloth, rubber, or other flexible material. A slatted material with a flexible backing also could be suitable as long as the balls 10 can smoothly travel down the runner 4 up the ramp 14 over the roll 6 and towards the goals 8. The runner 4 similarly could have a flexible magnetic layer capable of having targets magnetically placed atop the runner. These targets could even be placed prior to rolling up the runner 4 such that they remain in place when unfurled for later use.

The game system 2 is set up by unfurling the runner 4 from the roll 6 as shown in FIG. 6. This is done until the cavity is revealed as shown in FIG. 7 between the cylindrical ends 24 of the roll 6, after which the components of the game system can be removed. The two support rods 16 are then connected to the cylindrical ends 24 on one end and the runner 4 on the other end. They may be secured to the runner using one or more ground stakes 18 passing through receivers 20 on the runner. This forms the ramp 14.

Next, the goals 8 are placed by securing each receiver cup 22 to the ground using ground stakes. Once this is done, the game is ready to be played. There are several options for gameplay.

For example, for a two-player game, Player one throws the pallino 12 target ball over the ramp. Player two gets to roll first in this scenario. Players get points by hitting the targets or by being closest to the pallino 12. Players get the number of points marked on each receiver cup 22 for every ball 10 that goes in a goal 8. Similar to bocce, the player that is closest to the pallino gets the number of points equal to how many of their bocce's are closer to the pallino than the other team's nearest bocce. If the player's bocce touches the pallino, it is called a "Baci" and the team earns 2 points for that ball. The player with less points for the round gets to re-throw the pallino 12 and the player with more points shoots first on each consecutive round. Players continue through rounds until a player hits a predetermined score threshold.

For a four-person game, players team up, two players for each team, and take turns. Scoring is the same as the two-player version.

For a single-player game, the player aims to score for the highest number of points by shooting at the targets with all the balls except the small target ball 12 (pallino). Points are tallied and the player tries to get a record score with all of the scoring balls 10.

Variations of the game can punish players for landing too closely to the pallino 12, cancelling scores in receiver cups 22 based upon opposing team's balls 10 in the same receiver cup, or other common variations in head-to-head gameplay.

The receiver cups 22 could be outfitted with lights, such as light emitting diodes (LEDs) or other ornamentation which aids in playing of the game.

The runner 4 could include a magnetic layer, which would allow for magnetic weights to be placed on the surface to secure the runner into place, and also to facilitate additional scoring or challenge to the game. The targets 22 could be secured to a portion of the runner in such a manner as well, such that the targets are predefined by the magnetic weights.

The targets 22 could also be weighted rather than relying on the ground stakes 18.

III. Alternative Embodiment Game System 52

Figure 9:
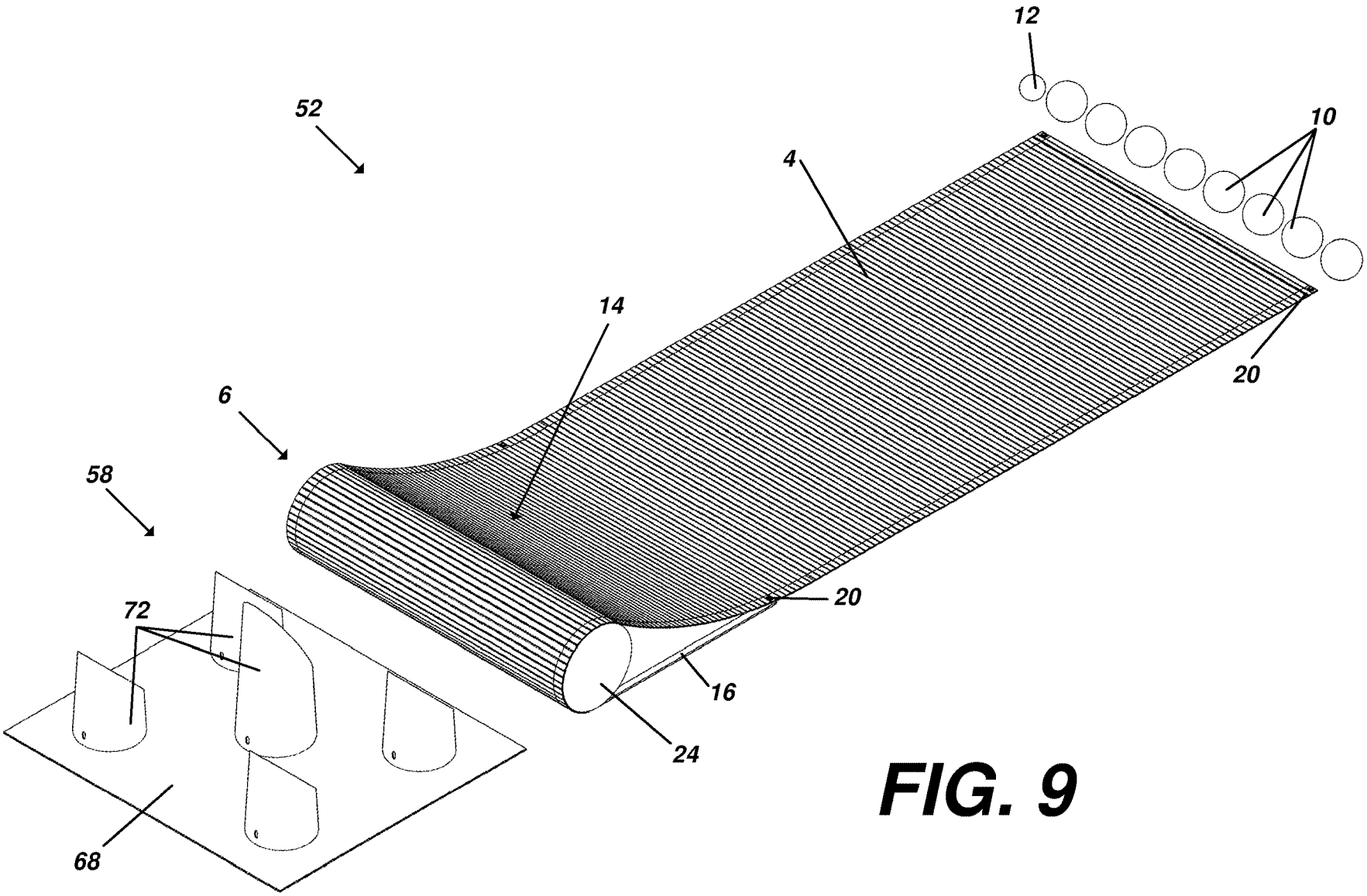
FIG. 9 is three-dimensional isometric view of an alternative embodiment of the present invention shown in a deployed, in-use orientation.

FIG. 9 shows a slightly alternative embodiment game system 52 where the goals 58 consist of a number of targets 72 having at least partially ferro-magnetic components and a magnetic sheet 68 which secures the targets 72 in place during use. The magnetic sheet 68 could have markers which indicate where the various targets 72 are supposed to be placed for a particular game.

It is to be understood that while certain embodiments and/or aspects of the invention have been shown and described, the invention is not limited thereto and encompasses various other embodiments and aspects.

Having thus described the invention, what is claimed as new and desired to be secured by Letters Patent is:

1. A portable game system comprising:

a runner comprising a flexible material and having a proximal end and a distal end, said runner configured to be laid flat to form a playing surface thereby forming a first, deployed orientation;

a roll comprising a pair of end caps forming an interior space, said runner proximal end affixed to said roll;

said runner forming a ramp between said proximal end and said distal end in proximity with said roll;

a plurality of balls selectively storable within said interior space;

a plurality of goals oriented in proximity with said roll, said goals being selectively storable within said interior space; and wherein said balls are configured to be rolled along said runner, up and over said ramp, and to land in proximity of said goals.

2. The portable game system of claim 1, further comprising:

said runner configured to be transformed into a second, stored orientation whereby said runner is wrapped around said pair of end caps, thereby sealing said interior space between said pair of end caps.

3. The portable game system of claim 1, wherein said runner may be deployed on any suitable surface selected from the list comprising: grass; concrete; pavement; hardwood; carpet; and astroturf.

4. The portable game system of claim 1, further comprising a plurality of light emitting diodes (LEDs) placed within said runner and said goals.

5. The portable game system of claim 1, wherein said runner comprises a plurality of slats.

6. The portable game system of claim 1, further comprising a pallino configured to be rolled along said runner, up and over said ramp, and to land in proximity of said goals prior to the rolling of the balls.

7. The portable game system of claim 1, further comprising:

a pair of support rods each selectively deployable between a respective one of said pair of end caps and a receiver located along a side edge of said runner; and said pair of support rods configured to support and retain said ramp.

8. The portable game system of claim 1, further comprising:

a pair of support rods each selectively deployable between a respective one of said pair of end caps and a receiver located along a side edge of said runner; and said pair of support rods configured to support and retain said ramp.

9. The portable game system of claim 1, wherein each of said plurality of goals is weighted.

10. The portable game system of claim 1, wherein said runner comprises a magnetic layer.

11. The portable game system of claim 10, wherein at least one magnetized element is connected to said runner magnetically via said magnetic layer.

12. A method of playing a game, the method comprising the steps:

providing a portable game system comprising a roll defined by pair of end caps and a runner comprising a flexible material having a proximal end and a distal end, wherein the proximal end of said runner is connected to said pair of end caps;

unfurling said runner from said pair of end caps, thereby transforming said portable game system from a first, stored orientation to a second, deployed orientation wherein a portion of said runner is laid flat to form a playing surface;

forming a ramp with said runner and said pair of end caps;

exposing an opening within said roll between said pair of end caps, said opening containing a plurality of balls and targets;

setting up said targets on an opposite side of said pair of end caps from said playing surface and said ramp; and rolling said balls along aid playing surface, up said ramp, and toward said targets.

13. The method of claim 12, further comprising the steps:

removing said targets and said balls and placing them within said opening of said roll;

wrapping said runner about said end caps, thereby covering said opening; and transforming said portable game surface from said second, deployed orientation to said first, stored orientation.

14. The method of claim 12, further comprising the steps:

providing a pair of support rods;

connecting a respective one of said pair of support rods to a respective one of said pair of end caps;

connecting said respective one of said pair of support rods to said runner; and reinforcing said ramp with said support rods.

* * * * *